United States Patent [19]

Ganz

[11] Patent Number: 5,021,022

[45] Date of Patent: Jun. 4, 1991

[54] SADDLE CONNECTION FOR BALLOONS

[76] Inventor: Gilbert J. Ganz, 2927 Exposition Blvd., Los Angeles, Calif. 90018

[21] Appl. No.: 550,190

[22] Filed: Jul. 9, 1990

[51] Int. Cl.[5] ..... A63H 33/00

[52] U.S. Cl. ..... 446/220; 446/222

[58] Field of Search ..... 446/220, 222; 428/24; 273/33

[56] References Cited

U.S. PATENT DOCUMENTS

| | | | |
|---|---|---|---|
| 4,428,149 | 1/1984 | Brown | 446/222 |
| 4,661,081 | 4/1987 | Basseches | 446/222 |
| 4,715,841 | 12/1987 | Nelson et al. | 446/222 |
| 4,798,554 | 1/1989 | Nelson et al. | 446/222 |
| 4,837,059 | 6/1989 | Milne | 446/222 |

*Primary Examiner*—Mickey Yu
*Assistant Examiner*—David J. Kenealy
*Attorney, Agent, or Firm*—Erik M. Arnheim

[57] ABSTRACT

A saddle connector for attaching an amusement balloon to the upper end of a carrying rod (stick). The saddle connector includes a slotted post and four arms radiating outwardly and upwardly from the upper end of the post. A tail area of the balloon can be extended downwardly through spaces between the arms and then around the post to attach the balloon to the connector.

4 Claims, 1 Drawing Sheet

SADDLE CONNECTION FOR BALLOONS

BACKGROUND AND SUMMARY OF THE INVENTION

Ornamental air-filled balloons have become popular amusement devices. One type of balloon is formed of two facing plastic sheets, each sheet including a main circular section and an auxiliary tail section. The sheets are adhered together around their aligned peripheral edges, after which pressurized air is introduced through the tail area into the confined space between the circular sheet sections. The end of the tail area is then sealed to trap the air within the confined space. These balloons have the general appearance of a puffed-up circular pillow. Very often the faces of these balloons are transparent or brightly colored, e.g. bright silver or metallic blue, etc. Slogans and images of cartoon characters are sometimes printed on face areas of the balloons. The balloons can be relatively small, (e.g. two inches in diameter) or relatively large (e.g. ten inches in diameter), with the axial thickness varying from about one inch to about four inches.

Commonly the balloons are attached to a short plastic rod (stick) having a length of about twelve inches. The person will hold the rod in order to move or to carry the balloon from one place to another.

The present invention concerns a saddle connector usable between the aforementioned rod and the balloon, said connector being designed to form a concave seat for the lower curvilinear surface of the balloon, with the tail area of the balloon being wrapped around a portion of the saddle connector to retain the balloon in place on the connector. The connector can be formed separately from the associated rod (stick), in which case the connector will have a cylindrical socket structure formed thereon for fitting the connector onto the upper end of the rod. Alternately the saddle connector can be formed integrally with the rod. The present invention relates to the structure of the saddle connector (not to the method of attaching the connector onto the rod).

There is already in existence a saddle structure designed to fit against the lower curvilinear surface of a balloon. This pre-existing saddle structure has a funnel configuration, i.e. an inverted conical shape. One or more slots extend from the upper edge (rim) of the funnel downwardly along the funnel wall toward the funnel axis; a cylindrical post extends downwardly from the lower end of the funnel. The balloon is attached to the saddle structure by extending the tail of the balloon through the slot into the funnel wall and wrapping the tail one or more times around the cylindrical post; the free end of the tail can be redirected into the slot to prevent the tail material from unwinding off the post.

There are some disadvantages with the funnel-type saddle connector. For example, the circular rim of the funnel does not seat evenly against the balloon surface because the balloon surface curvature is different in the axial direction (compared to the circumferential direction); the balloon is apt to wobble on the connector. Also, when the funnel structure is used with small sized balloons the funnel side wall partially covers the undersurface of the balloon, thereby obscuring any message that might appear on that part of the balloon surface. Especially when the balloon is small, the funnel becomes a prominent part of the overall assembly, thereby tending to detract from the overall appearance of the balloon. This disadvantage can be partially overcome by making the funnel in a smaller size; however in that event the slot (or slots) becomes smaller (shorter), thereby making it somewhat more difficult to draw the tail area of the balloon through the slot.

The saddle connector of the present invention is designed to at least partially overcome the disadvantages of the funnel-type connector. Instead of a funnel, the connector employs two pairs of oppositely extending curved arms as the balloon-engagement components of the connector. These arms are configured to have an even (similar) engagement pressure against the balloon surface, thereby partially avoiding any wobble that might otherwise exist between the balloon and the connector.

The arms on the connector are spaced apart so that the arms do not tend to cover up (obscure) any message that might appear on the lower surface of the balloon. Also, the spaced arms have spaced contacts with the balloon, such that a given size connector can be used with a range of different sized balloons. The connector can be a relatively small size item; typically the tips of the connector arms can be less than one inch apart.

The newly-proposed connector includes a small post extending downwardly from the curved arms. A diametrical slot extends through the post to receive the tail area of the balloon. The location of the slot in the post (rather than at a point further up on the connector) helps in anchoring the balloon on the connector, since the downward pulling force on the tail area of the balloon is applied within the post relatively close to the post axis. Also, it becomes somewhat easier to wrap the tail area around the post, since the wrapping motion starts on the post rather than above the post. A further advantage of the newly-proposed connector is the fact that the relatively wide spaces between the arms can be used to receive the extreme end of the tail.

THE DRAWINGS

DESCRIPTION OF A PREFERRED EMBODIMENT OF THE INVENTION

Figure 1:
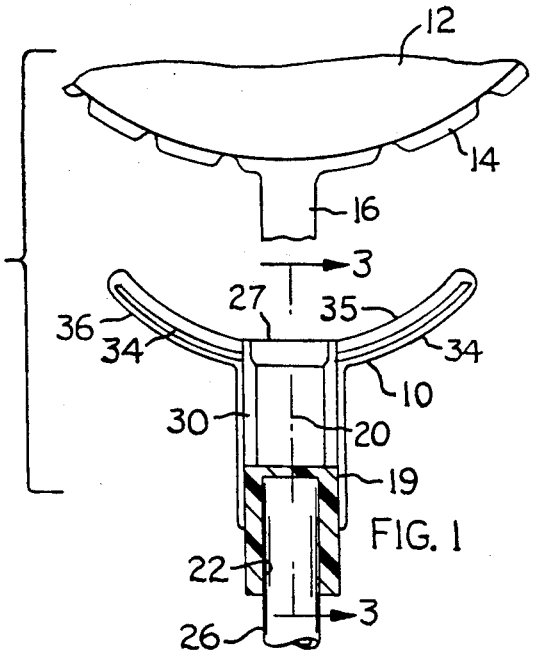
FIG. 1 is a fragmentary exploded view of a balloon and a saddle connector embodying features of the invention.

The drawings show a saddle connector 10 of the present invention in association with a conventional air-filled balloon 12. The balloon has a circular appearance as viewed in FIG. 1, and an oval shape as viewed in FIG. 2. As indicated earlier, the balloon is formed by two facing plastic sheets adhered together to form a peripheral edge seam; the seam flange is denoted by numeral 14 in FIGS. 1 and 2. The balloon surface is curvilinear in both planes (FIGS. 1 and 2), although the curvature is different in the different planes. Air is trapped within the balloon via a flexible tail area 16, shown fragmentarily in the drawings. Typically the tail area will have a length of about three inches, sufficient for wrapping the tail area around connector 10 so as to affix the balloon to the connector.

Saddle connector 10 includes an upstanding post 19 that defines a vertical central axis 20. The lower end of the post has a circular cylindrical socket 22 therein for attachment of the connector to a plastic rod 26. Typically the rod will have a diameter of about one eighth inch, and a length of about twelve inches; only a portion of the rod is visible in FIG. 1.

Figure 2:
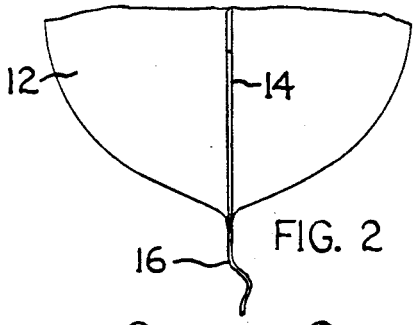
FIG. 2 is a fragmentary side elevational view of the balloon shown in FIG. 1.
Figure 3:
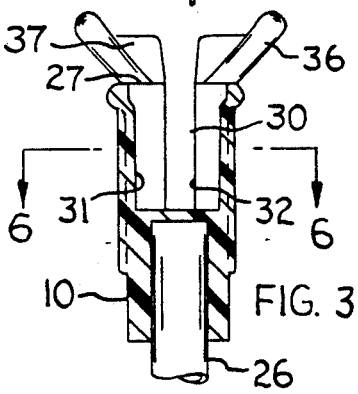
FIG. 3 is a sectional view taken on line 3—3 in FIG. 1.
Figure 6:
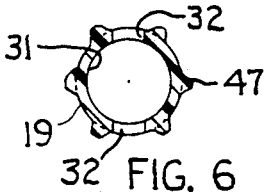
FIG. 6 is a sectional view taken on line 6—6 in FIG. 3.

The upper end portion of post 19 is hollow and transversely slotted from its upper end 27 downwardly to a point just above socket 22. A diametrical vertical slot 30 extends transversely through the post. As shown in FIGS. 2 and 6, the slot includes a cylindrical cavity portion 31 and two rectangular slot end portions 32. However, the slot could be a straight diametrical slot having a width corresponding to the width of slot portions 32. Cylindrical cavity portion 31 is advantageous in reducing the quantity of material needed to form the connector, but the cylindrical configuration is not essential to practice of the invention.

Figure 7:
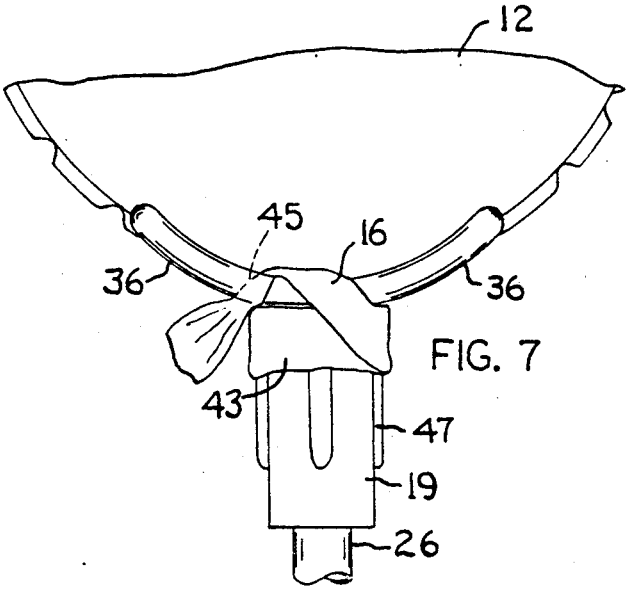
FIG. 7 is a front elevational view of the FIG. 1 saddle connection, with a balloon installed thereon.

Extending radially outwardly from the upper end of post 19 are four radial arms 34. Each arm has an upper face 35 that curves outwardly and upwardly from the post, as seen in FIG. 1. The four arms collectively define a concave seating structure for the convex lower surface of balloon 12. FIG. 7 shows the balloon seated against the curved arms.

Each of the four curved arms 34 includes a circular cross-sectioned rib 36 and a flange 37 extending laterally from the rib toward an imaginary vertical centerplane 39 defined by slot 30. As seen best in FIG. 4, the radial edge 40 of each flange 37 forms a continuation of an edge of the slot 30 in post 19. This is helpful in guiding the tail area 16 of the balloon downwardly into slot 30 during the process of tying the tail area around the saddle connector.

Figure 4:
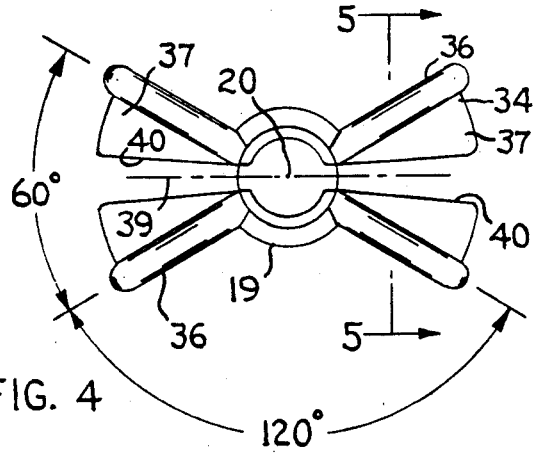
FIG. 4 is a top plan view of the saddle connector shown in FIG. 1.
Figure 5:
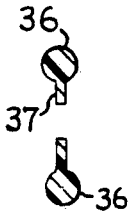
FIG. 5 is a sectional view taken on line 5—5 in FIG. 4.

Arms 34 are arranged in two pairs extending in opposite directions from post 19. As seen in FIG. 4, one pair of arms extends rightwardly from post 19, while the other pair of arms extends leftwardly from the post. The circumferential spacing of the two pair of arms is approximately one hundred twenty degrees, such that relatively wide spaces are provided for looping a portion of the balloon tail area 16 over (around) any one of the arms. The one hundred twenty degree spacing also enables the curved arms to better conform to the differences in curvature of the balloon surface in its major plane (FIG. 1) and its minor plane (FIG. 2). The tip of each rib 36 has approximately the same contact pressure on the balloon surface, such that the balloon has a fairly stable fit in (on) the connector. The tip of each rib 36 is preferably rounded (spherical) to minimize the possibilities for puncture.

The ribs 36 in each pair of arms 34 are circumferentially spaced apart approximately sixty degrees, as shown in FIG. 4. The ribs are the major contact points on the balloon surface, although flanges 37 will also be in contact with the balloon surface.

The tail area 16 of the balloon can be wrapped around connector 10 in various ways or directions. A preferred method of wrapping is to position the balloon on the connector so that tail area 16 extends downwardly through the space between the radial edges 40 on adjacent ones of flanges 37. With the balloon pulled down onto the saddle connector (by a downward pull on tail area 16) the tail area is drawn around post 19 one or two times (revolutions), after which the free end of the tail is looped over one of the ribs 36 and through the space between either pair of radial edges 40. In FIG. 7, the area of tail 16 wrapped around post 19 is designated by numeral 43; the tail area looped over a rib 36 is designated by numeral 45.

In order to strengthen the connector the surface of post 19 may include thereon a number of vertical projections (ribs) 47. The connector can be formed as a one piece plastic molding as a separate component from rod 26. In an alternate arrangement the connector could be formed as an integral part of the rod. The saddle connector is preferably a relatively small size item wherein post 19 has a length somewhat less than one inch. Because of its small size, the connector has an unobtrusive appearance that prevents it from detracting from the overall appearance of the balloon. Ribs 36 are widely spaced (in FIG. 7) so they do not conceal or obscure any printing on the undersurface of the balloon.

What is claimed is:

1. A saddle connector for an inflated balloon, comprising an upstanding post having an upper end, a slot extending diametrically through the post from its upper end downwardly to a point located a considerable distance below said upper end; two pairs of balloon-engagement arms extending in opposite directions radially away from the upper end of said post, each arm having an upper face that curves outwardly and upwardly from the post, such that the four arms collectively define a concave seating structure for the convex lower surface of an inflated balloon; the arms in each pair of arms extending from a point on the post that borders a side edge of the slot, such that the arms in each pair are spaced from each other by the width of the slot; the slots and the spaces between the arms serving to accommodate the tail portion of a balloon resting against the aforementioned concave seating structure; each said arm including a circular cross-sectional rib and a flange extending laterally from the rib toward an imaginary vertical centerplane defined by the diametrical slot.

2. The saddle connector of claim 1, wherein each flange has a radial edge that forms a continuation of an edge of said slot, whereby the tail of a balloon can be guided toward the slot by one of said radial edges.

3. The saddle connector of claim 1, wherein the circular cross-sectioned ribs in each pair of arms are circumferentially spaced apart approximately sixty degrees, measured from the axis of the upstanding post.

4. A saddle connector for an inflated balloon, comprising an upstanding post having an upper end, a slot extending diametrically through the post from its upper end downwardly to a point located a considerable distance below said upper end; two pairs of balloon-engagement arms extending in opposite directions radially away from the upper end of said post, each arm having an upper face that curves outwardly and upwardly from the post, such that the four arms collectively define a concave seating structure for the convex lower surface of an inflated balloon; the arms in each pair of arms extending from a point on the post that borders a side edge of the slot, such that the arms in each pair are spaced from each other by the width of the slot; the slots and the spaces between the arms serving to accommodate the tail portion of a balloon resting against the aforementioned concave seating structure; said two pairs of arms being spaced apart approximately one hundred twenty degrees, measured from the axis of the upstanding post.

* * * * *